US011528933B2

(12) United States Patent
Ballesteros Gomez et al.

(10) Patent No.: US 11,528,933 B2
(45) Date of Patent: Dec. 20, 2022

(54) SMOKING ARTICLE

(71) Applicant: BRITISH AMERICAN TOBACCO (INVESTMENTS) LIMITED, London (GB)

(72) Inventors: Pablo Javier Ballesteros Gomez, London (GB); Jeremy Phillips, London (GB); Mark Forster, London (GB); Hans-Josef Chadjim, London (GB)

(73) Assignee: NICO VENTURES TRADING LIMITED, London (GB)

( * ) Notice: Subject to any disclaimer, the term of this patent is extended or adjusted under 35 U.S.C. 154(b) by 497 days.

(21) Appl. No.: 16/465,063

(22) PCT Filed: Nov. 29, 2017

(86) PCT No.: PCT/GB2017/053593
§ 371 (c)(1),
(2) Date: May 29, 2019

(87) PCT Pub. No.: WO2018/100366
PCT Pub. Date: Jun. 7, 2018

(65) Prior Publication Data

US 2019/0380379 A1 Dec. 19, 2019

(30) Foreign Application Priority Data

Nov. 30, 2016 (GB) ..... 1620352

(51) Int. Cl.

| | |
|---|---|
| ***A24B 15/34*** | (2006.01) |
| ***A24D 3/14*** | (2006.01) |
| ***A24B 15/16*** | (2020.01) |
| ***A24B 15/12*** | (2006.01) |
| ***A24F 47/00*** | (2020.01) |
| ***B65D 85/10*** | (2006.01) |
| ***A24D 1/20*** | (2020.01) |
| ***A24C 5/01*** | (2020.01) |
| ***A24B 15/32*** | (2006.01) |
| ***A24B 15/167*** | (2020.01) |
| ***A24D 3/17*** | (2020.01) |

(52) U.S. Cl.
CPC ..... *A24B 15/32* (2013.01); *A24B 15/12* (2013.01); *A24B 15/167* (2016.11); *A24B 15/34* (2013.01); *A24C 5/01* (2020.01); *A24D 1/20* (2020.01); *A24D 3/14* (2013.01); *A24D 3/17* (2020.01); *B65D 85/10* (2013.01)

(58) Field of Classification Search
None
See application file for complete search history.

(56) References Cited

U.S. PATENT DOCUMENTS

| | | | | | |
|---|---|---|---|---|---|
| 4,060,091 | A * | 11/1977 | Watson | A24B 15/34 | 131/276 |
| 4,153,679 | A * | 5/1979 | Rowsell | A24B 15/32 | 131/202 |
| 4,193,936 | A * | 3/1980 | Watson | A23G 3/36 | 564/123 |
| 5,451,404 | A * | 9/1995 | Furman | A61K 8/34 | 424/401 |
| 5,530,225 | A * | 6/1996 | Hajaligol | A24F 40/46 | 219/535 |
| 6,692,835 | B1 | 2/2004 | Tomei | | |

(Continued)

FOREIGN PATENT DOCUMENTS

| | | | |
|---|---|---|---|
| CN | 1193901 | A | 9/1998 |
| CN | 101410028 | A | 4/2009 |

(Continued)

OTHER PUBLICATIONS

International Preliminary Report on Patentability for Application No. PCT/GB2017/053593, dated Jun. 13, 2019, 11 pages.
Office Action For Japanese Application No. 2019-525856, dated Aug. 25, 2020, 10 pages.
Office Action for Korean Application No. 10-2019-7015657, dated Sep. 23, 2020, 9 pages.
International Search Report and Written Opinion, Application No. PCT/GB2017/053593, dated Jul. 24, 2018, 15 pages.

(Continued)

*Primary Examiner* — Dennis R Cordray
(74) *Attorney, Agent, or Firm* — Patterson Thuente, P.A.

(57) ABSTRACT

In one aspect an aerosol-generating device comprising a smoking article and a heat source is described. The smoking article includes a smokable material and a cooling agent, the smokable material including a tobacco component. The heat source is disposed to heat, but not burn the smokable material in use. The cooling agent comprises a compound or a combination of compounds according to either of the following formulae, racemates, enantiomers and salts thereof (I, II).

(I)

(II)

13 Claims, No Drawings

(56) References Cited

U.S. PATENT DOCUMENTS

| | | | | |
|---|---|---|---|---|
| 2005/0000529 | A1* | 1/2005 | Bereman | A24B 15/34 131/334 |
| 2015/0000592 | A1 | 1/2015 | Schnakenberg et al. | |
| 2015/0107608 | A1* | 4/2015 | Kadiric | A24B 15/284 131/284 |
| 2016/0249675 | A1* | 9/2016 | Branton | A24D 3/06 131/335 |
| 2016/0255879 | A1 | 9/2016 | Paprocki | |
| 2018/0116277 | A1* | 5/2018 | Besso | A24D 3/061 |

FOREIGN PATENT DOCUMENTS

| | | | |
|---|---|---|---|
| CN | 101573099 | B | 8/2011 |
| CN | 102381936 | A | 3/2012 |
| CN | 102844386 | A | 12/2012 |
| CN | 103271438 | A | 9/2013 |
| CN | 103274959 | A | 9/2013 |
| CN | 103435479 | A | 12/2013 |
| CN | 104023857 | A | 9/2014 |
| CN | 104126875 | A | 11/2014 |
| CN | 104703492 | A | 6/2015 |
| CN | 104800090 | A | 7/2015 |
| CN | 104812732 | A | 7/2015 |
| CN | 105105317 | A | 12/2015 |
| DE | 102011118354 | | 5/2013 |
| GB | 1351762 | A | 5/1974 |
| GB | 1558103 | | 12/1979 |
| JP | H09510627 | A | 10/1997 |
| JP | 2006333713 | A | 12/2006 |
| JP | 2014500037 | A | 1/2014 |
| JP | 2015513393 | A | 5/2015 |
| JP | 2015516816 | A | 6/2015 |
| WO | WO 2009/027331 | A2 * | 3/2009 |
| WO | WO 2012156699 | | 11/2012 |
| WO | WO-2013016470 | A2 | 1/2013 |
| WO | WO-2013072013 | A1 | 5/2013 |
| WO | WO 2013164706 | | 11/2013 |
| WO | WO 2016174137 | | 11/2016 |

OTHER PUBLICATIONS

Bharate et al.; "Modulation of Thermoreceptor TRPM8 by Cooling Compounds"; ACS Chemical Neuroscience, vol. 3, No. 4, Apr. 18, 2012 (Apr. 18, 2012), pp. 248-267, XP055090754, ISSN: 1948-7193, DOI: 10.1021/cn300006u the whole document figures 3-9, 15-16.

McKemy, David D.; "TRPM8: The Cold and Menthol Receptor—TRP Ion Channel Function in Sensory Transduction and Cellular Signaling Cascades—NCBI Bookshelf"; Jan. 1, 2007 (Jan. 1, 2007), XP055465040, Retrieved from the Internet: URL:https://www.ncbi.nlm.nih.gov/books/NBK5238/.

Leffingwell, Cooler than Menthol; Jun. 2016 (Jun. 8, 2016), XP055465069, Retrieved from the Internet: URL:http://www.leffingwell.com/cooler than menthol.htm.

Office Action for Chinese Application No. 2017800726299, dated Apr. 21, 2021, 16 pages.

Office Action and Search Report for Chinese Application No. 201780072629, dated Dec. 13, 2021, 38 pages.

* cited by examiner

SMOKING ARTICLE

PRIORITY CLAIM

The present application is a National Phase entry of PCT Application No. PCT/GB2017/053593, filed Nov. 29, 2017, which claims priority from GB Patent Application No. 1620352.3, filed Nov. 30, 2016, each of which is hereby fully incorporated herein by reference.

TECHNICAL FIELD

The present invention relates to a smoking article for use with an aerosol-generating device, and a method of manufacturing such a smoking article.

BACKGROUND

Articles such as cigarettes, cigars and the like burn tobacco during use to create tobacco smoke. Attempts have been made to provide alternatives to these types of articles, which burn tobacco, by creating products that release compounds without burning. Apparatus is known that heats smokable material to volatilize at least one component of the smokable material, typically to form an aerosol which can be inhaled, without burning or combusting the smokable material. Such apparatus is sometimes described as a "heat-not-burn" apparatus or a "tobacco heating product" (THP) or "tobacco heating device" or similar. Various different arrangements for volatilizing at least one component of the smokable material are known.

The material may be for example tobacco or other non-tobacco products or a combination, such as a blended mix, which may or may not contain nicotine.

As referred to herein, an "aerosol generating device" is apparatus that generates an inhalable aerosol by heating, but not burning, a smokable material.

SUMMARY

At its most general, the claimed invention relates to the inclusion of a cooling agent in a consumable for use in a tobacco heating product.

According to a particular embodiment of the present invention, there is provided an aerosol generating device comprising a smoking article, the smoking article comprising a smokable material and a cooling agent as defined in claim 1, the aerosol generating device further comprising a heat source disposed to heat, but not burn the smokable material in use.

A claimed embodiment also provides a smoking article for use in an aerosol generating device, the smoking article comprising a tobacco component and a cooling agent as defined in claim 1.

A claimed embodiment also provides a method of manufacturing a smoking article for use with an aerosol-generating device, the method comprising:

- applying a cooling agent comprising a compound according to formula (I) or (II) to a tobacco component to form a smokable material;
- optionally, applying menthol to the tobacco component; and
- combining the smokable material with a filter to provide a smoking article.

In a further aspect, a claimed embodiment provides a pack for smoking articles, the pack comprising:

- a container defining a chamber for storing smoking articles and an opening through which smoking articles are removable from the chamber;
- one or more smoking articles disposed within the container, the smoking articles comprising a (i) smokable material including a tobacco component and menthol, and/or (ii) a filter including menthol;
- wherein at least a portion of the chamber is lined with paper foil, the paper foil comprising menthol.

In an embodiment, the smoking articles in this claimed embodiment are for use in a tobacco heating product.

In a claimed embodiment, the invention provides a pack for smoking articles, the pack comprising:

- a container defining a chamber for storing smoking articles and an opening through which smoking articles are removable from the chamber;
- one or more smoking articles disposed within the container, the smoking articles comprising a (i) smokable material including a tobacco component and menthol, and (ii) a filter including menthol;
- wherein at least a portion of the chamber is lined with paper foil, the paper foil comprising menthol.

Further features and advantages of the invention will become apparent from the following description of various embodiments, given by way of example only, which is made with reference to the accompanying drawings.

Definitions

The term "$C_{1-4}$ alkyl" encompasses optionally substituted straight chain or branched chain hydrocarbon groups having from 1, 2, 3, or 4 carbon atoms or a range comprising any of two of those integers. Examples include methyl (Me), ethyl (Et), propyl (Pr), isopropyl (i-Pr), butyl (Bu), isobutyl (i-Bu), sec-butyl (s-Bu), tert-butyl (t-Bu) and the like. Unless the context requires otherwise, the term "$C_{1-4}$ alkyl" also encompasses alkyl groups containing one less hydrogen atom such that the group is attached via two positions (i.e., divalently). Such groups are also referred to as "$C_{1-4}$ alkylene" groups. An example of such an alkylene is methylene ($=CH_2$).

The term "$C_{3-6}$ cycloalkyl" refers to non-aromatic cyclic hydrocarbon groups having from 3, 4, 5, or 6 carbon atoms or a range comprising any of two of those integers including cyclopropyl, cyclobutyl, cyclopentyl, cyclohexyl and the like. It will be understood that cycloalkyl groups may be saturated such as cyclohexyl or unsaturated such as cyclohexenyl.

The terms "hydroxy" and "hydroxyl" refer to the group —OH. The term "oxo" refers to the group =O. The term "$C_{1-4}$ alkoxyl" refers to the group O($C_{1-4}$ alkyl). Examples include methoxy, ethoxy, propoxy, isoproxy, butoxy, tert-butoxy and the like. The oxygen atom may be located along the hydrocarbon chain, and need not be the atom linking the group to the remainder of the compound (and such a substituent may be referred to alternatively as an alkylene-alkoxy group; for example, this may be denoted as $(CH_2)_t O(CH_2)_u CH_3$ or $(CH_2)_t O(CH_2)_u OH$ where t and u are independently 1 to 4).

The term "carboxylate" or "carboxyl" refers to the group $—COO^-$ or —COOH.

The term "ester" refers to a carboxyl group having the hydrogen replaced with, for example a $C_{1-4}$ alkyl group ("alkylester"), an aryl or aralkyl group ("arylester" or "aralkylester") and so on. An ester may generally be shown as $CO_2R$. $CO_2C_{1-4}$ alkyl groups are preferred, such as for example, methylester ($CO_2Me$), ethylester ($CO_2Et$) and propylester ($CO_2Pr$).

The term "cyano" refers to the group —CN. The term "amino" refers to the group —$NH_2$.

The term "substituted amino" or "secondary amino" refers to an amino group having a hydrogen replaced with, for example a $C_{1-4}$ alkyl group ("$C_{1-4}$alkylamino"), an aryl or aralkyl group ("arylamino", "aralkylamino") and so on. A substituted amino may generally be shown as NHR. Examples of $C_{1-4}$alkylamino groups include methylamino (NHMe), ethylamino (NHEt) and propylamino (NHPr).

The term "disubstituted amino" or "tertiary amino" refers to an amino group having the two hydrogens replaced with, for example a $C_{1-4}$ alkyl group, which may be the same or different ("dialkylamino"), an aryl and alkyl group ("aryl (alkyl)amino") and so on. A disubstituted amino may generally be shown as $NR_aR_b$. Examples of di($C_{1-4}$ alkyl)amino include dimethylamino ($NMe_2$), diethylamino ($NEt_2$), dipropylamino ($NPr_2$) and variations thereof (e.g. N(Me)(Et) and so on).

The term "acyl" or "aldehyde" refers to the group —C(=O)H.

The term "substituted acyl" or "ketone" refers to an acyl group having a hydrogen replaced with, for example a $C_{1-4}$ alkyl group ("$C_{1-4}$ alkylacyl" or "alkylketone" or "ketoalkyl"), an aryl group ("arylketone"), an aralkyl group ("aralkylketone") and so on. A ketone may generally be shown as C(O)R, or COR.

The term "amido", "carboxamide" or "amide" refers to the group —$C(O)NH_2$ (also shown as $CONH_2$).

The term "aminoacyl" refers to the group —NHC(O)H.

The term "substituted amido" "substituted carboxamide" or "substituted amide" refers to an amido group having a hydrogen replaced with, for example a $C_{1-4}$ alkyl group ("$C_{1-4}$ alkylamido" or "$C_{1-4}$ alkylamide"), an aryl ("arylamido"), aralkyl group ("aralkylamido") and so on. Substituted amides may generally be shown as —C(O)NHR or CONHR. Examples of substituted amides include methylamide (—C(O)NHMe), ethylamide (—C(O)NHEt) and propylamide (—C(O)NHPr).

The term "disubstituted amido" "disubstituted carboxamide" or "disubstituted amide" refers to an amido group having the two hydrogens replaced with, for example a $C_{1-4}$ alkyl group ("di($C_{1-6}$ alkyl)amido") or "di($C_{1-6}$ alkyl)amide"), an aralkyl and alkyl group ("alkyl(aralkyl)amido") and so on. Disubstituted amides may generally be shown as —$C(O)NR_aR_b$ or $CONR_aR_b$. Examples of disubstituted amides include dimethylamide (—$C(O)NMe_2$), diethylamide (—$C(O)NEt_2$) and dipropylamide (—$C(O)NPr_2$) and variations thereof (e.g. —C(O)N(Me)Et and so on). Disubstituted amides also include moieties generally shown as $NR^aR^b$, where $R^a$ and $R^b$ join together to form a cyclic group, for example a 3-7 membered heterocyclyl.

The term "aryl" refers to any group containing a carbocyclic (non-heterocyclic) aromatic ring. The aromatic ring or ring system is generally composed of 6 carbon atoms, and may be phenyl (Ph).

The term "aralkyl" refers to an aryl group substituted with a $C_{1-6}$alkyl group. Examples include benzyl (—$CH_2C_6H_5$) and phenethyl (—$CH_2CH_2C_6H_5$).

The term "heterocyclyl" refers to a moiety obtained by removing a hydrogen atom from a ring atom of a heterocyclic compound which moiety has from 3 to 6 ring atoms (unless otherwise specified), of which 1 or 2 are ring heteroatoms each heteroatom being independently selected from 0 and N.

In this context, the prefixes 3-, 4-, 5-, 6- and 7-membered denote the number of ring atoms, or range of ring atoms, whether carbon atoms or heteroatoms. For example, the term "3-7 membered heterocyclyl", as used herein, pertains to a heterocyclyl group having 3, 4, 5, 6 or 7 ring atoms or a range comprising any of two of those integers. Examples of heterocyclyl groups include 5-7-membered monocyclic heterocyclyls. Specific examples include oxolane, dioxolane, pyrrolidine and pyrrolidone.

Heterocyclyls also encompass aromatic heterocyclyls and aliphatic heterocyclyls. Such groups may be substituted or unsubstituted.

The term "aromatic heterocyclyl" may be used interchangeably with the term "heteroaromatic" or the term "heteroaryl" or "hetaryl". The heteroatoms in the aromatic heterocyclyl group may be independently selected from N, S and O.

"Heteroaryl" is used herein to denote a heterocyclic group having aromatic character and embraces aromatic monocyclic ring systems. The term aromatic heterocyclyl also encompasses pseudoaromatic heterocyclyls. An example of an aromatic heterocyclyl group is pyridinyl.

As used herein, the terms "flavor" and "flavoring" refer to materials which, where local regulations permit, may be used to create a desired taste or aroma in a product for adult consumers. They may include extracts (e.g., licorice, *hydrangea*, Japanese white bark *magnolia* leaf, chamomile, fenugreek, clove, Japanese mint, aniseed, cinnamon, herb, wintergreen, cherry, berry, peach, apple, Drambuie, bourbon, scotch, whiskey, spearmint, peppermint, lavender, cardamom, celery, cascarilla, nutmeg, sandalwood, bergamot, geranium, honey essence, rose oil, vanilla, lemon oil, orange oil, *cassia*, caraway, cognac, jasmine, ylang-ylang, sage, fennel, piment, ginger, anise, coriander, coffee, flavor enhancers, bitterness receptor site blockers, sensorial receptor site activators or stimulators, sugars and/or sugar substitutes (e.g., sucralose, acesulfame potassium, aspartame, saccharine, cyclamates, lactose, sucrose, glucose, fructose, sorbitol, or mannitol), and other additives such as charcoal, chlorophyll, minerals, botanicals, or breath freshening agents. They may be imitation, synthetic or natural ingredients or blends thereof. They may be in any suitable form, for example, oil, liquid, or powder.

Unless otherwise defined, the term "optionally substituted" or "optional substituent" as used herein refers to a group which may or may not be further substituted with 1, 2, 3, 4 or more groups, preferably 1, 2 or 3, more preferably 1 or 2 groups selected from the group consisting of $C_{1-4}$ alkyl (including straight chain and branched $C_{1-4}$ alkyl and further including $C_{1-4}$ alkyl incorporating a $C_{3-6}$ cycloalkyl moiety within the chain or as a spiro substituent), hydroxyl, oxo, $C_{1-4}$ alkoxy, carboxyl, esters, cyano, amino, monosubstituted amino, disubstituted amino, acyl, ketones, amides, aminoacyl, substituted amides, disubstituted amides, aryl, aralkyl, heterocyclyl and heteroaryl wherein each alkyl, alkenyl, alkynyl, cycloalkyl, aryl and heterocyclyl and groups containing them may be further optionally substituted.

DETAILED DESCRIPTION

Smokable Material

As used herein, the term "smokable material" includes materials that provide volatilized components upon heating, at least partly in the form of an aerosol. "Smokable material" includes any tobacco-containing material and may, for example, include one or more of tobacco, tobacco derivatives, expanded tobacco, shredded tobacco, reconstituted tobacco or tobacco substitutes, not restricted to the tobacco compositions that are described herein. "Smokable material" also may include other, non-tobacco, products, which, depending on the product, may or may not contain nicotine.

Apparatus is known that heats smokable material to volatilize at least one component of the smokable material to form an inhalable aerosol, without burning or combusting the smokable material. Such apparatus is sometimes described as a "heat-not-burn" apparatus or a "tobacco heating product" or "tobacco heating device" or similar. The apparatus is typically generally elongate, having an open end, sometimes referred to as the mouth end. The smokable material may be in the form of or provided as part of a cartridge or cassette or rod which can be inserted into the apparatus. A filter arrangement may be provided at the mouth end to filter and/or cool volatilized material as the material is drawn by the user. A heater for heating and volatilizing the smokable material may be provided as a "permanent" part of the apparatus or may be provided as part of the smoking article or consumable which is discarded and replaced after use. A "smoking article" in this context is a device or article or other component that includes the smokable material, which in use is heated to volatilize the smokable material, and optionally other components. In use, the smokable material is not burned or combusted. The tobacco compositions described herein are particularly useful in such smoking articles, and the smokable material can contain the tobacco compositions. Exemplary smokable material compositions for use with aerosol-generating devices are described in GB application no. 1521626.0, the entirety of which is incorporated by reference herein.

The aerosol-generating devices of the present disclosure contain smokable materials which comprise a tobacco component and, optionally, a cooling agent.

Cooling Agent

Smoking articles which burn smokable material, such as combustible cigarettes, progressively burn the substrate during a smoking session. That is, a lit cigarette gradually burns the substrate therein from the lit end, towards the mouth end.

Such articles which burn smokable material often incorporate menthol in either the smokable material, the filter, or the tipping paper. The menthol may be incorporated for a number of reasons, such as its cooling sensory effect and/or its mint taste. If the menthol is incorporated uniformly in the smokable material of a combustible cigarette, for instance, the user will perceive a relatively constant cooling sensory effect throughout a smoking session, as portions of menthol disposed throughout the combustible cigarette are gradually volatilized.

As used herein, 'cooling sensory effect' does not refer to a thermal cooling of the aerosol to be inhaled (i.e., a positive enthalpy of volatilization); rather, it refers to providing the user with a cooling sensation in the mouth. Without being bound by theory, said cooling sensation may derive from triggering the TRPM8 receptors in the mouth; menthol is known to be a TRMP8 agonist.

The inventors have found that menthol-containing smokable materials used in combustible products are not optimal for use with aerosol-generating devices, because it may provide an unsatisfactory sensory profile. For example, some aerosol-generating devices create an inhalable aerosol by heating a smokable material with heaters arranged around the circumference and along the length of the smoking article. This arrangement means that the bulk of the smokable material is heated at the same time. This is different from the progressive burn provided by a smoking article which burns the smokable material. Thus, a user inhaling aerosol generated from a menthol-containing smoking article in an aerosol-generating device may perceive a brief cooling sensation as the volatile menthol is volatilized at the start of a session of use, but perceive a lower cooling sensation thereafter. Such a sensory profile may be deemed inadequate by a user.

The inventors have found that including a cooling agent in a smoking article for use with an aerosol-generating device, preferably in the smokable material of said smoking article, changes the profile of the cooling effect over a session of use. The cooling sensation may be detected over a longer period during a smoking session, giving a sensory profile more similar to a menthol-containing combustible product. In particular, these non-menthol cooling agents may be TRPM8 agonists. A suitable cooling agent may comprise a compound according to formula (I), racemates, enantiomers and salts thereof:

(I)

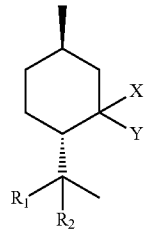

wherein

X is selected from $C(=O)R_3$ and $OR_4$;

Y is selected from H, and $OR^a$;

$R_1$ is selected from $CH_3$ and OH;

$R_2$ is selected from H and $CH_3$;

or $R_1$ and $R_2$ together form $=CH_2$ or $=O$;

$R_3$ is optionally substituted and selected from H; $C_{1-4}$ alkyl; $COR_5$; $CO_2R_5$; and $NR_6R_7$;

$R_4$ is optionally substituted and selected from $C_{1-4}$ alkyl; $COR_5$; $CO_2R_5$; or, where Y is $OR^a$, $R_4$ may be $R^b$ and $R^a$ and $R^b$ together form an optionally substituted $C_{2-4}$ alkylene group; or where $R_1$ is not $CH_3$, $R_4$ may be H;

$R_5$ is selected from H; $(CH_2)_tO(CH_2)$—OH where t and u are independently 1 to 4; $C_{1-4}$ alkyl optionally substituted with =O, alkoxy, OH, $CO_2H$, $CH_3$, $CON(R_8)_2$; and an optionally substituted 3-7-membered aliphatic heterocyclyl;

$R_6$ and $R_7$ are independently selected from H; $C_{1-4}$ alkyl optionally substituted with OH, $CO_2R_8$, a 5-7-membered heteroaryl or $C_{1-4}$ alkyl; $C_{3-6}$ cycloalkyl; 5-7-membered heteroaryl; and phenyl which is optionally substituted with $CH_3$, CN, $CH_2CN$, $CH_2CONH_2$, $OCH_3$, or OH;

$R_8$ is selected from H and $C_{1-4}$ alkyl;

and/or comprises a compound or combination of compounds according to formula (II), racemates, enantiomers and salts thereof:

(II)

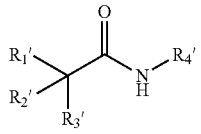

wherein $R_1'$ is selected from $CH(R_5')_2$ and $R^{a'}$;

$R_2'$ is selected from $CH(R_5')_2$ and $R^{b'}$, where $R^{a'}$ and $R^{b'}$ together with the carbon atom to which they are attached form an optionally substituted aliphatic 3-6-membered ring;

$R_3'$ is selected from H, $CH(R_5')_2$, and $C_{1-4}$ alkyl;

$R_4'$ is selected from $C_{1-4}$ alkyl optionally substituted with OH, $CO_2R_6'$, a 5-7-membered heteroaryl or $C_{1-4}$ alkyl; $CO_2R_6$; $C_{3-6}$ cycloalkyl; 5-7-membered heteroaryl; and phenyl which is optionally substituted with $CH_3$, CN, $CH_2CN$, $CH_2CONH_2$, $OCH_3$, or OH;

$R_5'$ is selected from H and $C_{1-4}$ alkyl optionally substituted with OH;

$R_6'$ is selected from H and $C_{1-4}$ alkyl.

In some embodiments, $R^{a'}$ and $R^{b'}$ together with the carbon atom to which they are attached form an optionally substituted $C_6$ cycloalkylene. In some cases, the $C_6$ cycloalkylene may be mono- or di-substituted with $C_{1-4}$ alkyl group(s). In some cases, $R^{a'}$ and $R^{b'}$ together with the carbon atom to which they are attached form a 2-isopropyl-5-methylcyclohexylene group as illustrated below (where * indicates the point of attachment):

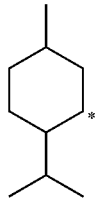

In particularly preferred cases, this group may be:

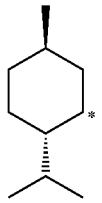

In some embodiments, the cooling agent comprises a compound or a combination of compounds according to formula (Ia), racemates, enantiomers and salts thereof:

(Ia)

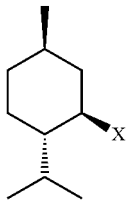

wherein

X is selected from $C(=O)R_3$ and $OR_4$ $R_3$ is optionally substituted and selected from H; $C_{1-4}$ alkyl; $COR_5$; $CO_2R_5$; and $NR_6R_7$;

$R_4$ is optionally substituted and selected from $C_{1-4}$ alkyl; $COR_5$; and $CO_2R_5$;

$R_5$ is selected from H; $(CH_2)_tO(CH_2)$—OH where t and u are independently 1 to 4; $C_{1-4}$ alkyl optionally substituted with =O, alkoxy, OH, $CO_2H$, $CH_3$, $CON(R_8)_2$; and an optionally substituted 3-7-membered aliphatic heterocyclyl;

$R_6$ and $R_7$ are independently selected from H; $C_{1-4}$ alkyl optionally substituted with OH, $CO_2R_8$, a 5-7-membered heteroaryl or $C_{1-4}$ alkyl; $CO_2R_8$; $C_{3-6}$ cycloalkyl; 5-7-membered heteroaryl; and phenyl which is optionally substituted with $CH_3$, CN, $CH_2CN$, $CH_2CONH_2$, $OCH_3$, or OH;

$R_8$ is selected from H and $C_1$-$C_4$ alkyl;

and/or a compound or combination of compounds according to formula (II), racemates, enantiomers and salts thereof:

(II)

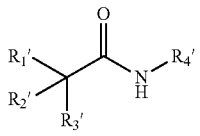

wherein $R_1'$ is selected from $CH(R_5')_2$ and $R^{a'}$;

$R_2'$ is selected from $CH(R_5')_2$ and $R^{b'}$, where $R^{a'}$ and $R^{b'}$ together with the carbon atom to which they are attached form 2-isopropyl-5-methylcyclohexylene;

$R_3'$ is selected from H and $CH(R_5')_2$;

$R_4'$ is selected from $C_{1-4}$ alkyl optionally substituted with OH, $CO_2R_6'$, a 5-7-membered heteroaryl or $C_{1-4}$ alkyl; $CO_2R_6$; $C_{3-6}$ cycloalkyl; 5-7-membered heteroaryl; and phenyl which is optionally substituted with $CH_3$, CN, $CH_2CN$, $CH_2CONH_2$, $OCH_3$, or OH;

$R_5'$ is selected from H and $CH_3$;

$R_6'$ is selected from H and $C_1$-$C_4$ alkyl.

In some embodiments, the cooling agent may comprise a compound according to formula (Ib), racemates, enantiomers and salts thereof:

(Ib)

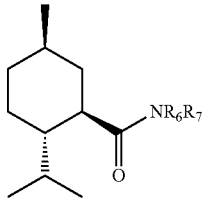

wherein $R_6$ and $R_7$ are independently selected from H; $C_{1-4}$ alkyl optionally substituted with OH, $CO_2R_8$, a 5-7-membered heteroaryl or $C_{1-4}$ alkyl; $C_{3-6}$ cycloalkyl; 5-7-membered heteroaryl; and phenyl which is optionally substituted with $CH_3$, CN, $CH_2CN$, $CH_2CONH_2$, $OCH_3$, or OH; and $R_8$ is selected from H and $C_{1-4}$ alkyl.

In some embodiments, the cooling agent may comprise a compound according to formula (IIa), racemates, enantiomers and salts thereof:

(IIa)

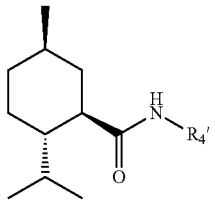

wherein $R_4'$ is selected from $C_{1-4}$ alkyl optionally substituted with OH, $CO_2R_6'$, a 5-7-membered heteroaryl or $C_{1-4}$ alkyl; $CO_2R_6$; $C_{3-6}$ cycloalkyl; 5-7-membered heteroaryl; and phenyl which is optionally substituted with $CH_3$, CN, $CH_2CN$, $CH_2CONH_2$, $OCH_3$, or OH; and $R_6'$ is selected from H and $C_{1-4}$ alkyl.

For the avoidance of doubt, the cooling agent according to formula (I) or (II) is not menthol.

In a preferred embodiment, the cooling agent may comprise any compound or combination of compounds described herein wherein the compound(s) are GRAS (Generally Recognized As Safe by the Food and Drug Administration).

In particular the cooling agent may be selected from the following compounds:

| Number | Structure |
|---|---|
| 1 | 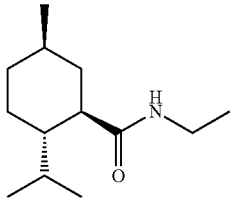 |
| 2 | 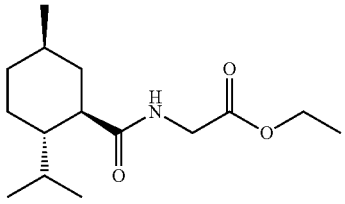 |
| 3 | 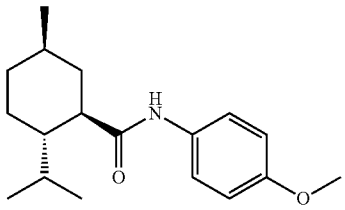 |
| 4 | 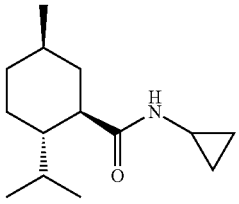 |

-continued

| Number | Structure |
|---|---|
| 5 | 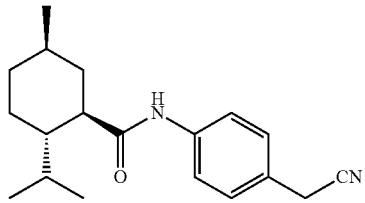 |
| 6 | 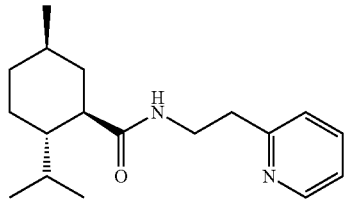 |
| 7 | 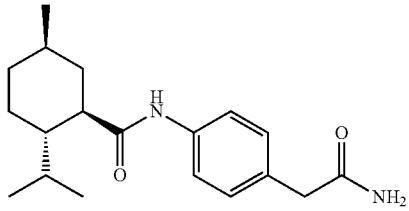 |
| 8 | 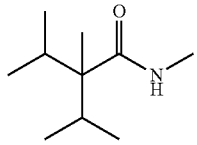 |
| 9 | 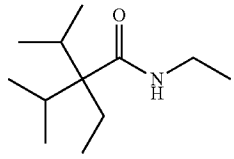 |
| 10 | 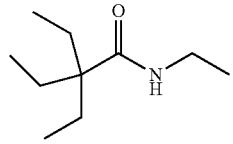 |
| 11 | 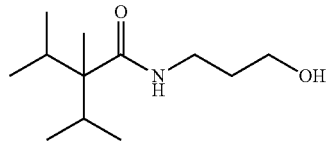 |
| 12 | 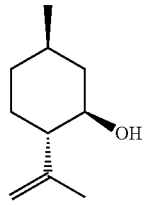 |

-continued
| Number | Structure |
|---|---|
| 13 | 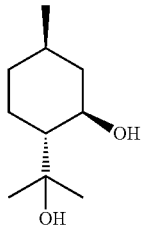 |
| 14 | 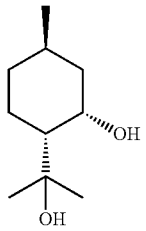 |
| 15 | 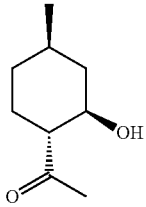 |
| 16 | 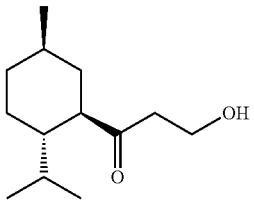 |
| 17 | 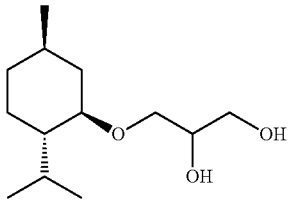 |
| 18 | 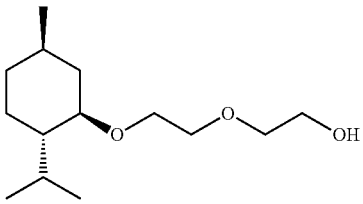 |
| 19 | 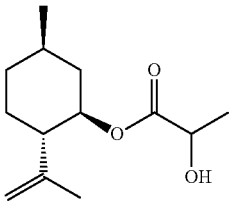 |
-continued
| Number | Structure |
|---|---|
| 20 | 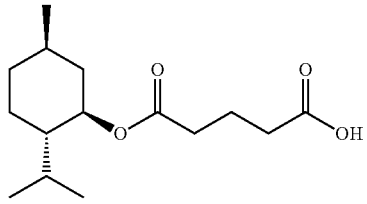 |
| 21 | 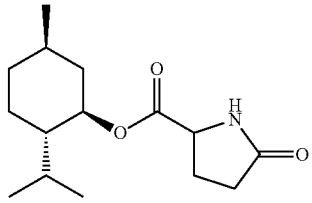 |
| 22 | 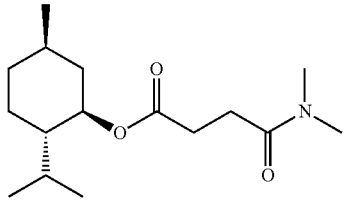 |
| 23 | 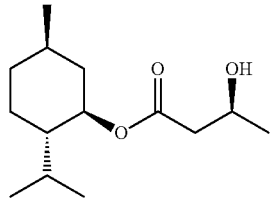 |
| 24 | 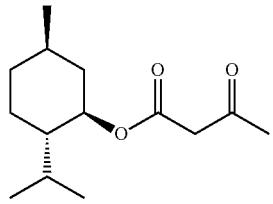 |
| 25 | 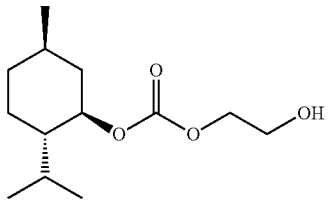 |
| 26 | 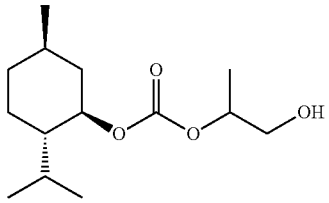 |

-continued

| Number | Structure |
|---|---|
| 27 | 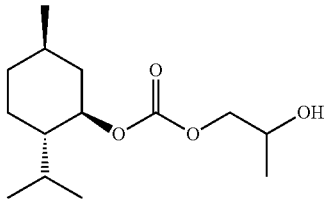 |
| 28 | 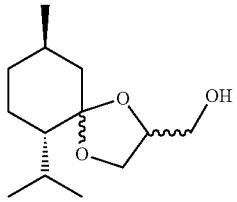 |
| 29 | 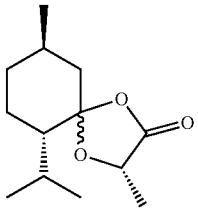 |

Particularly suitable cooling agents may comprise compounds selected from the group consisting of:

1 N-ethyl-2-isopropyl-5-methylcyclohexane carboxamide (also known as WS-3, CAS: 39711-79-0, FEMA: 3455);

2 2-isopropyl-N-[(ethoxycarbonyl)methyl]-5-methylcyclohexanecarboxamide (also known as WS-5, CAS: 68489-14-5, FEMA: 4309);

3 2-isopropyl-N-(4-methoxylphenyl)-5-methylcyclohexanecarboxamide (also known as WS-12, FEMA: 4681);

8 2-isopropyl-N,2,3-trimethylbutanamide (also known as WS-23, FEMA: 3804);

or combinations thereof.

In a particular embodiment, the cooling agent comprises N-ethyl-2-isopropyl-5-methylcyclohexane carboxamide. In a further embodiment, the cooling agent consists essentially of N-ethyl-2-isopropyl-5-methylcyclohexane carboxamide.

The cooling agent may be located anywhere in the smoking article, such as in or on the smokable material or in the filter. In a preferred case, the cooling agent may be located in the smokable material. The cooling agent may be impregnated into the smokable material.

The inventors have found a particularly preferred embodiment in which the cooling agent is combined with menthol in the aerosol-generating device. The cooling sensation perceived by the user from said embodiment comprising cooling agent and menthol has a greater intensity and duration than would be expected by the simple addition of the cooling effects of menthol and cooling agent.

A smokable material may comprise cooling agent and menthol in any suitable amount, for example the ratio of cooling agent:menthol w/w may be from about 1:1 to about 1:150; or from about 1:2 to about 1:50, or from about 1:10 to about 1:40, or about 1:30. In some embodiments, the ratio of cooling agent:menthol w/w may be less than 1:150, or less than 1:50, or less than 1:40, or less than 1:35. In some embodiments, the ratio of cooling agent:menthol w/w may be greater than 1:1, or greater than 1:2, or greater than 1:5, or greater than 1:10, or greater than 1:25.

In some cases, it may be beneficial for the cooling agent to comprise a compound with a lower vapor pressure than menthol. That is, it may be beneficial for the cooling agent to comprise a compound which is less volatile than menthol. For example, the compound may have a vapor pressure of less than about 106 Pa, less than about 100 Pa, or less than about 90 Pa at 20° C.

Alternatively or additionally, the compound may have a higher boiling point than menthol. For example, the compound may have a boiling point of greater than about 220° C., or 250° C., or 300° C., or 350° C., or 400° C.

Thus, one embodiment of the present invention is an aerosol-generating device comprising a smokable material and a cooling agent, the smokable material comprising a tobacco component; and a heat source disposed to heat, but not burn the smokable material in use; wherein the cooling agent is selected from those described above. A preferred embodiment of the present invention provides the cooling agent as a component of the smokable material.

Tobacco Component

In the tobacco compositions described herein, the tobacco component contains paper reconstituted tobacco. The tobacco component may also contain leaf tobacco, extruded tobacco, and/or bandcast tobacco.

In the tobacco compositions described here, the tobacco composition may contain a filler component. The filler component is generally a non-tobacco component, that is, a component that does not include ingredients originating from tobacco. The filler component may be a non-tobacco fiber such as wood fiber or pulp or wheat fiber. The filler component may also be an inorganic material such as chalk, perlite, vermiculite, diatomaceous earth, colloidal silica, magnesium oxide, magnesium sulphate, magnesium carbonate. The filler component may also be a non-tobacco cast material or a non-tobacco extruded material. The filler component may be present in an amount of 0 to 20% by weight of the tobacco composition, or in an amount of from 1 to 10% by weight of the composition. In some embodiments, the filler component is absent.

In the tobacco compositions described herein, the tobacco composition contains an aerosol generating agent. In this context, an "aerosol generating agent" is an agent that promotes the generation of an aerosol. An aerosol generating agent may promote the generation of an aerosol by promoting an initial vaporization and/or the condensation of a gas to an inhalable solid and/or liquid aerosol. In some embodiments, an aerosol generating agent may improve the delivery of flavor from the aerosol generating material.

In general, any suitable aerosol generating agent or agents may be included in the aerosol generating material of the invention. Suitable aerosol generating agents include, but are not limited to: a polyol such as sorbitol, glycerol, and glycols like propylene glycol or triethylene glycol; a non-polyol such as monohydric alcohols, high boiling point hydrocarbons, acids such as lactic acid, glycerol derivatives, esters such as diacetin, triacetin, triethylene glycol diacetate, triethyl citrate or myristates including ethyl myristate and isopropyl myristate and aliphatic carboxylic acid esters such as methyl stearate, dimethyl dodecanedioate and dimethyl tetradecanedioate.

In some embodiments, the aerosol generating agent may be glycerol, propylene glycol, or a mixture of glycerol and propylene glycol. Glycerol may be present in an amount of from 10 to 20% by weight of the tobacco composition, for example 13 to 16% by weight of the composition, or 14 to 15% by weight of the composition. Propylene glycol, if present, may be present in an amount up to about 2%, 1.8% or 1.6% by weight of the composition. Propylene glycol, if present, may be present in an amount of from 0.1 to 1.6 or 0.1 to 0.3% by weight of the composition.

The aerosol generating agent may be included in any component, for example any tobacco component, of the tobacco composition, and/or in the filler component, if present. Alternatively or additionally the aerosol generating agent may be added to the tobacco composition separately. In either case, the total amount of the aerosol generating agent in the tobacco composition should be as defined herein.

The tobacco compositions described herein contain nicotine. The nicotine content is from 0.5 to 2.5% by weight of the tobacco composition, and may be, for example, from 0.8 to 1.2% by weight of the tobacco composition. In embodiments, the nicotine content may be from 0.8 to 1.0% by weight of the tobacco composition. It has been surprisingly found that, when used in a tobacco heating product, if the nicotine content is too high, a harsh sensation may be produced in use when the aerosol is inhaled.

In the compositions described herein, where amounts are given in % by weight, for the avoidance of doubt this refers to a dry weight basis, unless specifically indicated to the contrary. Thus, any water that may be present in the tobacco composition, or in any component thereof, is entirely disregarded for the purposes of the determination of the weight %. The water content of the tobacco compositions described herein may vary and may be, for example, from 5 to 15% by weight. The water content of the tobacco compositions described herein may vary according to, for example, the temperature, pressure and humidity conditions at which the compositions are maintained. The water content can be determined by Karl-Fisher analysis, or by gas chromatography, as described herein.

On the other hand, for the avoidance of doubt, even when the aerosol generating agent is a component that is in liquid phase, such as glycerol or propylene glycol, any component other than water is included in the weight of the tobacco composition. However, when the aerosol generating agent is provided in the tobacco component of the tobacco composition, or in the filler component (if present) of the tobacco composition, instead of or in addition to being added separately to the tobacco composition, the aerosol generating agent is not included in the weight of the tobacco component or filler component, but is included in the weight of the "aerosol generating agent" in the weight % as defined herein. All other ingredients present in the tobacco component are included in the weight of the tobacco component, even if of non-tobacco origin (for example non-tobacco fibers in the case of paper reconstituted tobacco).

In an embodiment, the tobacco composition comprises the tobacco component as defined herein and the aerosol generating agent as defined herein. In an embodiment, the tobacco composition consists essentially of the tobacco component as defined herein and the aerosol generating agent as defined herein. In an embodiment, the tobacco composition consists of the tobacco component as defined herein and the aerosol generating agent as defined herein.

Paper Reconstituted Tobacco

Paper reconstituted tobacco is present in the tobacco component of the tobacco compositions described herein in an amount of from 70 to 100% by weight of the tobacco component. In embodiments, the paper reconstituted tobacco is present in an amount of from 80 to 100% by weight, or 90 to 100% by weight, of the tobacco component. In a further embodiment, the tobacco component consists essentially of, or consists of, paper reconstituted tobacco.

Paper reconstituted tobacco refers to tobacco material formed by a process in which tobacco feedstock is extracted with a solvent to afford an extract of solubles and a residue comprising fibrous material, and then the extract (usually after concentration, and optionally after further processing) is recombined with fibrous material from the residue (usually after refining of the fibrous material, and optionally with the addition of a portion of non-tobacco fibers) by deposition of the extract onto the fibrous material. The process of recombination resembles the process for making paper.

The paper reconstituted tobacco may be any type of paper reconstituted tobacco that is known in the art. In a particular embodiment, the paper reconstituted tobacco is made from a feedstock comprising one or more of tobacco strips, tobacco stems, and whole leaf tobacco. In a further embodiment, the paper reconstituted tobacco is made from a feedstock consisting of tobacco strips and/or whole leaf tobacco, and tobacco stems. However, in other embodiments, scraps, fines and winnowings can alternatively or additionally be employed in the feedstock.

The paper reconstituted tobacco for use in the tobacco compositions described herein may be prepared by methods which are known to those skilled in the art for preparing paper reconstituted tobacco.

Leaf Tobacco

Leaf tobacco may optionally be included in the tobacco compositions described herein. If leaf tobacco is included, it may be present, for example, in an amount of from 10 to 30% by weight, or 10 to 20% by weight, of the tobacco component.

The leaf tobacco which may be used in the tobacco compositions described herein may be any suitable tobacco, such as single grades or blends, cut rag or whole leaf, including Virginia (flue-cured) and/or Burley and/or Oriental.

The leaf tobacco may include ingredients such as aerosol generating agents (as defined herein), casings (as defined herein) and flavors (as defined herein).

Extruded Tobacco

Extruded tobacco may optionally be included in the tobacco compositions described herein. If extruded tobacco is included, it may be present, for example, in an amount of from 10 to 30% by weight, or 10 to 20% by weight, of the tobacco component.

The extruded tobacco which may be used in the tobacco compositions described herein may be prepared by methods which are known to those skilled in the art for preparing extruded tobacco.

In some embodiments, extruded tobacco can be prepared as follows.

The tobacco furnish may include Virginia (flue cured) tobacco, Burley tobacco, and/or Oriental tobacco. The tobacco furnish may be stems, scraps, strips, fines, or winnowings.

Additional components may include non-tobacco fiber, such as straw fiber or wheat fibers; binders, for example celluloses or modified celluloses such as hydroxypropyl cellulose and carboxymethylcellulose; and casings, for example acids such as malic acid.

Bandcast Tobacco

Bandcast tobacco may optionally be included in the tobacco compositions described herein. If bandcast tobacco is included, it may be present, for example, in an amount of from 10 to 30% by weight, or 10 to 20% by weight, of the tobacco component.

The bandcast tobacco which may be used in the tobacco compositions described herein may be prepared by methods which are known to those skilled in the art for preparing bandcast tobacco.

A bandcast tobacco may comprise tobacco or tobacco extract (or both), filler, aerosol generating agent (as defined herein), and binder.

The filler as discussed in this section as an ingredient in bandcast tobacco is distinct from the filler component that may be present in the tobacco compositions as defined herein, however similar materials may be used for the filler component.

A filler may be necessary to give the bandcast tobacco material a dry consistency which means that the material can be processed down-stream (shredded, blended, rolled, crimped, shaped etc.). The filler may comprise one or more inorganic filler materials, which include, but are not limited to: chalk, perlite, vermiculite, diatomaceous earth, colloidal silica, magnesium oxide, magnesium sulphate, magnesium carbonate, and suitable inorganic sorbents, such as molecular sieves. Chalk is particularly suitable. In some cases, the filler may comprise one or more organic filler materials, which include, but are not limited to: wood pulp, cellulose and cellulose derivatives.

In some embodiments, the filler may act as a sorbent and/or support for other substances in the bandcast tobacco. In some embodiments, it may act as a structure for adsorbing other substances before releasing them on heating. In some embodiments, it may act as a sorbent and/or support for an aerosol generating agent (as defined herein).

The binder may comprise one or more of an alginate, celluloses or modified celluloses, starches or modified starches, gelatins and natural or synthetic gums. Suitable binders include, but are not limited to: alginate salts comprising any suitable cation; celluloses or modified celluloses, such as hydroxypropyl cellulose and carboxymethylcellulose; starches or modified starches; polysaccharides such as pectin salts comprising any suitable cation, such as sodium, potassium, calcium or magnesium pectate; xanthan gum, guar gum, and any other suitable natural gums; and mixtures thereof. In some embodiments, the binder comprises, substantially consists of or consists of one or more alginate salts selected from sodium alginate, calcium alginate, potassium alginate or ammonium alginate.

The bandcast tobacco may further include additional ingredients, such as flavorings (as defined herein) and casings (as defined herein).

The bandcast tobacco may further include heat-conducting particles. These may improve the rate of heat transfer in use through the bandcast tobacco.

In some embodiments, the bandcast tobacco may additionally comprise a further tobacco material in addition to tobacco extract, such as ground tobacco, tobacco fiber, cut tobacco, extruded tobacco, tobacco stem and/or reconstituted tobacco.

In a particular embodiment, the smokable material comprises a tobacco component in an amount of from 60 to 90% by weight of the smokable material, a filler in an amount of 0 to 20% by weight of the smokable material, and an aerosol generating agent in an amount of from 10 to 20% by weight of the tobacco composition, wherein the tobacco composition has a nicotine content of from 0.5 to 1.5% by weight of the tobacco composition; and wherein the tobacco component comprises paper reconstituted tobacco in an amount of from 70 to 100% by weight of the tobacco component. The smokable material may additionally comprise a cooling agent as defined herein and/or menthol. For instance, the cooling agent may comprise a compound or compounds according to formula (I), (Ia), (Ib), (II) or (IIa), and/or menthol.

Device for Generating an Inhalable Aerosol

The tobacco compositions described herein can be used in a device for generating an inhalable aerosol. The device comprises a tobacco composition as described herein and a heating means which volatilizes components in use to form an aerosol. A variety of such devices are known in the art, and an example is disclosed in PCT/EP2014/072828, the entirety of which is incorporated by reference herein.

In some embodiments, the heating means is an electrical heating means. In some embodiments, the electrical heating means is an electrically resistive heating element. In some embodiments, the heating of the aerosol generating material does not result in any significant combustion of the material. In some embodiments, the heating results in no combustion or essentially no combustion of the aerosol generating material. In some embodiments, the device is a heat not burn device, also known as a tobacco heating device or a tobacco heating product. Such devices are non-combustion type smoking articles, developed as an alternative to conventional, combustible cigarettes. These devices volatilize components of tobacco by heating the tobacco material; pyrolysis or combustion of the tobacco or volatiles is avoided. The volatilized components condense to form an inhalable aerosol. The aerosol often comprises water, aerosol generating agent (as defined herein), nicotine and optionally other tobacco components such as flavors and aromas. Thus, in some embodiments, the device is one in which tobacco is heated to volatilize components without pyrolysis or combustion of the tobacco.

Using electricity to heat a tobacco composition in a smoking article has many advantages. In particular, it has many advantages over using combustion. Combustion is a complex process that generates aerosols by a combination of interactive physico-chemical processes which may include oxidative degradation, pyrolysis, pyrosynthesis, and distillation. It generally leads to the generation of complex aerosols. For example, smoke arising from a combustible smoking article comprising tobacco is a complex, dynamic mixture of more than 5000 identified constituents. The exothermic processes of combustion may be self-sustaining, and may result in heat generation rates, and heat output quantities, sufficient for degradation of the combustible matrix. In some cases, the matrix may be completely degraded to an ash residue which may comprise inorganic, non-combustible materials. Very high temperatures can be reached in burning cigarettes due to the exothermic reaction of combustion. In between taking puffs of a cigarette (the inter-puff smoldering period), the centre of the burning zone in the tobacco rod of the cigarette can reach temperatures as high as 800° C. During taking a puff of a cigarette, the periphery of the burning zone in the tobacco rod of the cigarette can reach temperatures as high as 910° C.

Using electrical heating systems (such as some heat not burn devices, also known as tobacco heating products or tobacco heating devices) is advantageous because the rate of heat generation is easier to control, and lower levels of heat are easier to generate, compared with using combustion for heat generation. In some embodiments, the device includes an actuator, which allows the user to initiate electrical heating.

The use of electrical heating systems therefore allows greater control over the generation of an aerosol from a tobacco composition. Furthermore, it allows for aerosol to be generated without combustion taking place, rather than through combustive degradation. Suitable electrical heating systems may use resistance and/or induction heaters.

In some embodiments, the devices of the invention are able to provide multiple deliveries or doses of aerosol. This means that the tobacco composition may be heated to produce sufficient aerosol to allow multiple puffs. This may be achieved by heating the tobacco composition for a period of time sufficient to produce a volume of aerosol suitable for multiple deliveries. In some embodiments, this may involve heating the tobacco composition constantly. Alternatively, this may involve successive, shorter periods of heating the tobacco composition, optionally with each period producing a single delivery or dose of aerosol.

In some embodiments, the device may be configured to heat the tobacco composition to a temperature of between about 50-350° C., 100-350° C., 150-350° C., 150-330° C., or 180-300° C.

In some embodiments, the tobacco composition, or smokable material comprising the tobacco composition, may be provided in a cartridge, and the cartridge may be insertable into the device. In some of these embodiments, this cartridge may be replaceable. In some embodiments, the cartridge may be combined with other parts of the aerosol generating device in any suitable way. In some embodiments, it may be attached to other parts of the device by a friction fit and/or a screw fit and/or a press fit. Thus, the tobacco composition may be provided in a smoking article which is consumable, to be used in conjunction with an apparatus for heating smokable material.

Physical Embodiment of Smoking Article

The smoking article may comprise one or more of a mouthpiece, a cooling chamber/element and a filter, for example.

The mouthpiece may be formed of for example paper, for example in the form of a spirally wound paper tube, cellulose acetate, cardboard, crimped paper, such as crimped heat resistant paper or crimped parchment paper, and polymeric materials, such as low density polyethylene (LDPE), or some other suitable material. The mouthpiece may comprise a tube. The tube may be a hollow tube. Such a hollow tube may provide a filtering function to filter volatilized smokable material and/or may provide a cooling function. The tube may be elongate, in order to be spaced from the very hot part(s) of the main apparatus that heats the smokable material.

The filter may be a filter plug, and may be made, for example, from cellulose acetate. The filter, if present, may be located at the downstream end of the mouthpiece.

The cooling chamber/element is provided to allow a components of a hot gaseous flow to condense and form an aerosol. The cooling chamber/element may be provided as part of the mouthpiece. The cooling chamber/element, if present, may be located at the upstream end of the mouthpiece. The cooling element may be a monolithic rod having first and second ends and comprising plural through holes extending between the first and second ends.

The mouthpiece, filter and/or cooling element may be joined to the smokable material by a tipping paper, which is wrapped round the mouthpiece/filter/cooling element and at least the adjacent end of the smokable material.

Method of Preparing Smoking Article

The smoking articles of the present invention may be prepared by any appropriate method. In particular, the smoking articles may be manufactured according to a method comprising applying a cooling agent to a tobacco component, the cooling agent being as defined herein (i.e. comprising a compound or compounds according to formula (I) or (II)), to form a smokable material. The smokable material may be combined with a filter to provide a smoking article. In one embodiment, menthol is also applied to the tobacco component. In one embodiment, the filter has been treated with menthol. In particular, the filter may comprise an acetate tow which has been treated with menthol.

Container for Smoking Articles

The smoking articles as described herein may be stored in a container prior to use with an aerosol-generating device. Such a pack may comprising a container defining a chamber for storing smoking articles and an opening through which smoking articles are removable from the chamber. The pack may contain one or more smoking articles disposed within the container, the smoking articles comprising a smoking material including a tobacco component and menthol, and a filter including menthol. In one embodiment, at least a portion of the chamber is lined with paper foil, the paper foil comprising menthol. That is, menthol is located in the smoking material, in the filter, and in the paper foil of the chamber. The inventors have found that including menthol in these three locations (the smokable material, the filter and the paper foil in the pack) results in a consumable in which high levels of menthol are delivered to the use during consumption, thus improving the user's smoking sensation.

In a further embodiment, at least one of the smoking material, filter and paper foil further comprise a cooling agent as defined herein. In another embodiment, at least two of the smoking material, filter and paper foil comprise a cooling agent as defined herein (i.e. a cooling agent comprising a compound or compounds according formula (I) or (II)): the smoking material and filter may comprise a comprise a cooling agent according to the present invention; the smoking material and paper foil may comprise a cooling agent according to the present invention; or the filter and the paper foil may comprise a cooling agent according to the present invention. In a further embodiment, the smoking material, filter and paper foil all comprise a cooling agent according to the present invention.

Other

The various embodiments described herein are presented only to assist in understanding and teaching the claimed features. These embodiments are provided as a representative sample of embodiments only, and are not exhaustive and/or exclusive. It is to be understood that advantages, embodiments, examples, functions, features, structures, and/or other aspects described herein are not to be considered limitations on the scope of the invention as defined by the claims or limitations on equivalents to the claims, and that other embodiments may be utilized and modifications may be made without departing from the scope of the claimed invention. Various embodiments of the invention may suitably comprise, consist of, or consist essentially of, appropriate combinations of the disclosed elements, components, features, parts, steps, means, etc., other than those specifically described herein. In addition, this disclosure may include other inventions not presently claimed, but which may be claimed in future.

The invention claimed is:

1. An aerosol-generating device comprising:

a smoking article comprising a smokable material, a cooling agent and method, wherein the cooling agent is impregnated into the smokable material, and the smokable material comprises a tobacco component; and a heat source disposed to heat, but not burn the smokable material in use;

wherein the cooling agent comprises:

a compound or a combination of compounds according to formula (I), racemates, enantiomers and salts thereof:

(I)

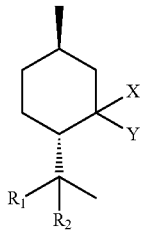

wherein

X is selected from the group consisting of $C(=O)R_3$ and $OR_4$;

Y is selected from the group consisting of H, and $OR^a$ $R_1$ is selected from the group consisting of $CH_3$ and OH;

$R_2$ is selected from the group consisting of H and $CH_3$;

or $R_1$ and $R_2$ together form at least $=CH_2$ or $=O$;

$R_3$ is selected from H; optionally substituted $C_{1-4}$ alkyl; $COR_5$; $CO_2R_5$; and $NR_6R_7$;

wherein $R_4$ is selected from the group consisting of optionally substituted $C_{1-4}$ alkyl; $COR_5$; $CO_2R_5$;

or, where Y is $OR^a$, $R_4$ may be $R^b$ and $R^a$ and $R^b$ together form an optionally substituted $C_{2-4}$ alkylene group; or where $R_1$ is not $CH_3$, $R_4$ may be H;

$R_5$ is selected from the group consisting of H; $(CH_2)_tO(CH_2)_uOH$ where t and u are independently 1 to 4; $C_{1-4}$ alkyl optionally substituted with $=O$, alkoxy, OH, $CO_2H$, $CH_3$, $CON(R_8)_2$; and an optionally substituted 3-7-membered aliphatic heterocyclyl;

$R_6$ and $R_7$ are independently selected from the group consisting of H; $C_{1-4}$ alkyl optionally substituted with OH, $CO_2R_8$, or a 5-7-membered heteroaryl; $C_{3-6}$ cycloalkyl; 5-7-membered heteroaryl; and phenyl which is optionally substituted with $CH_3$, CN, $CH_2CN$, $CH_2CONH_2$, $OCH_3$, or OH;

$R_8$ is selected from H and $C_{1-4}$ alkyl;

and/or a compound or combination of compounds according to formula (II), racemates, enantiomers and salts thereof:

(II)

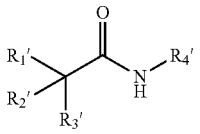

wherein $R_1'$ is selected from the group consisting of $CH(R_5')_2$ and $R^{a'}$;

$R_2'$ is selected the group consisting of from $CH(R_5')_2$ and $R^{b'}$, where $R^{a'}$ and $R^{b'}$ together with the carbon atom to which they are attached form an optionally substituted aliphatic 3-6-membered ring;

$R_3'$ is selected from the group consisting of H, $CH(R_5')_2$, and $C_{1-4}$ alkyl;

$R_4'$ is selected from $C_{1-4}$ alkyl optionally substituted with OH, $CO_2R_6'$, or a 5-7-membered heteroaryl; $CO_2R_6'$; $C_{3-6}$ cycloalkyl; 5-7-membered heteroaryl; and phenyl which is optionally substituted with $CH_3$, CN, $CH_2CN$, $CH_2CONH_2$, $OCH_3$, or OH;

$R_5'$ is selected from the group consisting of H and $C_{1-4}$ alkyl optionally substituted with OH;

$R_6'$ is selected from the group consisting of H and $C_{1-4}$ alkyl.

2. An aerosol-generating device according to claim 1, wherein the cooling agent comprises a compound or a combination of compounds according to formula (Ia), racemates, enantiomers and salts thereof:

(Ia)

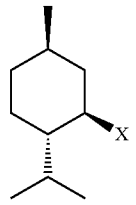

wherein $R_2'$ is selected from $CH(R_5')_2$ and $R^{b'}$, where $R^{a'}$ and $R^{b'}$ together with the carbon atom to which they are attached form 2-isopropyl-5-methylcyclohexylene;

$R_3'$ is selected from H and $CH(R_5')_2$; and $R_5'$ is selected from H and $CH_3$.

3. An aerosol-generating device according to claim 1, wherein the cooling agent has a vapor pressure of less than about 106 Pa at 20° C.

4. An aerosol-generating device according to claim 1, wherein the menthol is disposed in the smokable material.

5. An aerosol-generating device according to claim 1, further comprising a filter.

6. An aerosol-generating device according to claim 5, wherein menthol is disposed in the filter.

7. An aerosol-generating device according to claim 5, wherein menthol is disposed in the smokable material and in the filter.

8. An aerosol-generating device according to claim 1, wherein the weight ratio of cooling agent to menthol in the smoking article is from about 1:150 to about 1:1.

9. An aerosol-generating device according to claim 1, wherein the cooling agent is selected from the group consisting of:

1

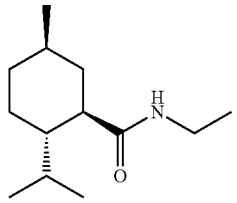

2

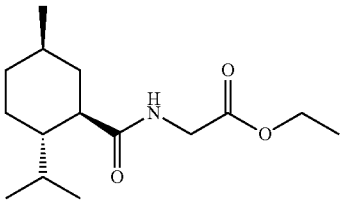

-continued
3
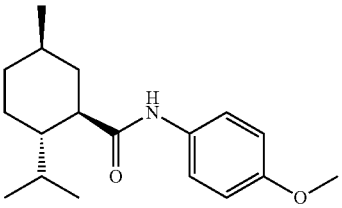
4
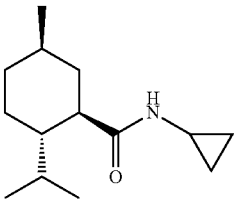
5
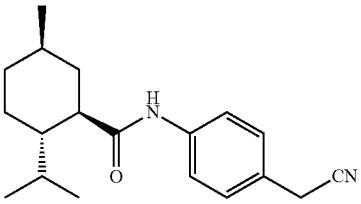
6
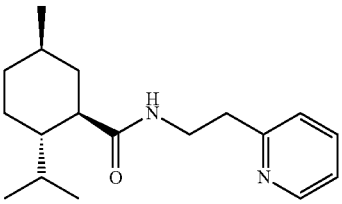
7
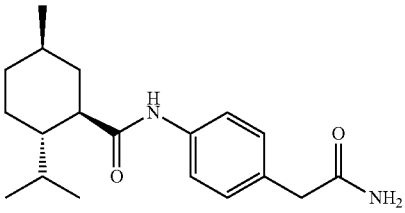
8
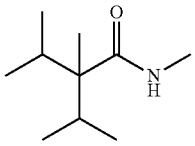
9
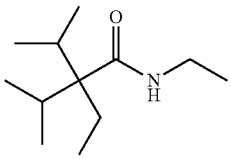
10
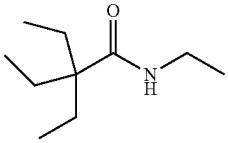
-continued
11
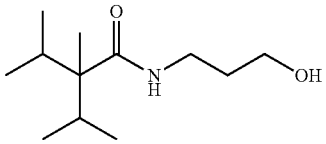
12
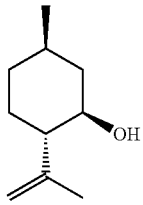
13
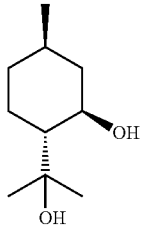
14
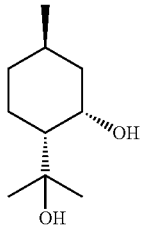
15
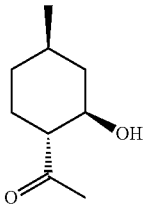
16
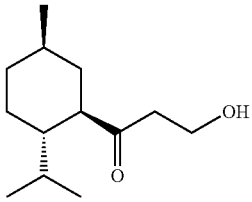
17
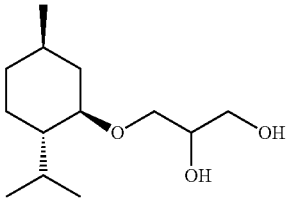

-continued

18

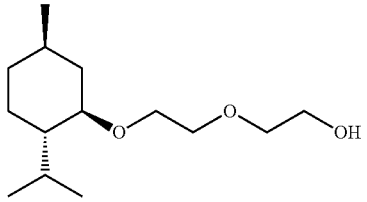

19

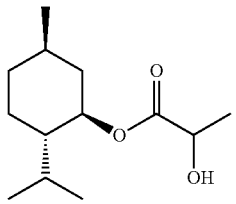

20

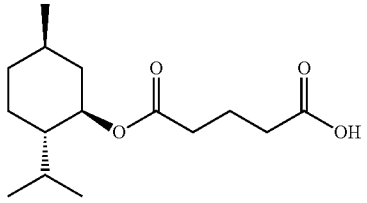

21

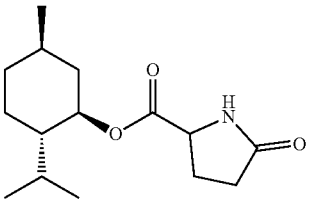

22

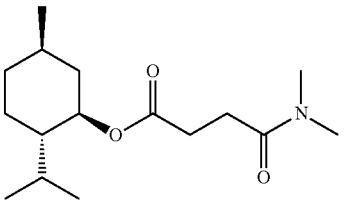

23

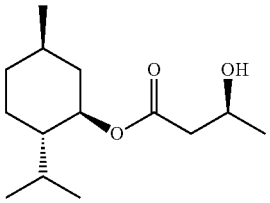

24

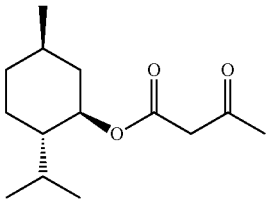

-continued

25

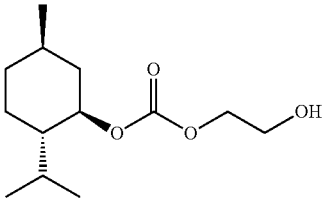

26

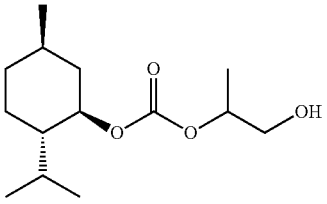

27

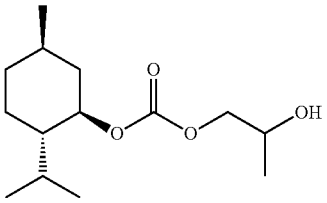

28

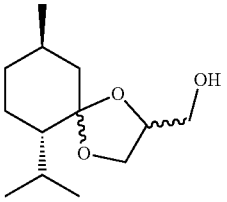

29

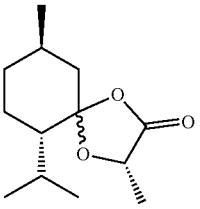

or combinations thereof.

10. An aerosol-generating device according to claim 1, wherein the cooling agent is selected from the group consisting of:

1 N-ethyl-2-isopropyl-5-methylcyclohexane carboxamide;

2-isopropyl-N-[(ethoxycarbonyl)methyl]-5-methylcyclohexanecarboxamide;

2-isopropyl-N-(4-methoxylphenyl)-5-methylcyclohexanecarboxamide;

2-isopropyl-N,2,3-trimethylbutanamide;

or combinations thereof.

11. A smoking article for use in an aerosol generating device, the smoking article comprising a smokable material, a cooling agent and method, wherein the cooling agent is impregnated into the smokable material, and the smokable material comprises a tobacco component; and wherein the cooling agent is as defined in claim 1.

12. A smoking article according to claim 11;

wherein the smokable material comprises a tobacco component in an amount of from 60 to 90% by weight of the smokable material, a filler in an amount of 0 to 20% by weight of the smokable material, and an aerosol generating agent in an amount of from 10 to 20% by weight of the tobacco composition, wherein the tobacco composition has a nicotine content of from 0.5 to 2.5% by weight of the tobacco composition; and wherein the tobacco component comprises paper reconstituted tobacco in an amount of from 70 to 100% by weight of the tobacco component.

13. A method of manufacturing a smoking article for use with an aerosol-generating device, the method comprising:

impregnating a cooling agent into a smokable material comprising a tobacco component, wherein the cooling agent is as defined in claim 1;

applying menthol to the tobacco component; and combining the smokable material with a filter to provide a smoking article.

* * * * *